US005653445A

United States Patent [19]

Quach

[11] Patent Number: 5,653,445

[45] Date of Patent: Aug. 5, 1997

[54] CARD GAME METHOD OF PLAY AND WAGERING

[76] Inventor: Hung Quach, 2634 New Ave., Rosemead, Calif. 91770

[21] Appl. No.: 567,954

[22] Filed: Dec. 6, 1995

[51] Int. Cl.[6] ..... A63F 1/00

[52] U.S. Cl. ..... 273/292; 273/274; 273/309

[58] Field of Search ..... 273/274, 292, 273/85 CP, 148 R, 309

[56] References Cited

U.S. PATENT DOCUMENTS

| | | | |
|---|---|---|---|
| 5,275,415 | 1/1994 | Wisted | 273/292 |
| 5,314,194 | 5/1994 | Wof | 273/292 |
| 5,366,228 | 11/1994 | Kangsanaraks | 273/292 |
| 5,452,900 | 9/1995 | Skratulia et al. | 279/292 |
| 5,476,265 | 12/1995 | Miller et al. | 273/292 |
| 5,522,595 | 6/1996 | Wong | 273/292 |
| 5,529,309 | 6/1996 | Bartlett | 273/292 |

OTHER PUBLICATIONS

"Back–Jack", Casino Gaming Concepts Inc., product brochure, 1995, 273/274 1995.

"California Baccarat", Casino Gaming Concepts Inc., product brochure, 1994, 273/292 1994.

*Primary Examiner*—William M. Pierce

*Attorney, Agent, or Firm*—Klein & Szekeres, LLP

[57] ABSTRACT

A card game and method of playing the same played with a standard 52 card deck is disclosed, wherein each of several players is dealt three cards and is given the opportunity to stand pat or to exchange one card for another dealt by a non-player dealer with the object of achieving a hand having a high score based on a numerical point scoring system in which the lowest hand score is zero and the highest is ten. Each such score is then compared with that of a predesignated reference player or "banker" to distinguish winning hands from losing hands. In those jurisdictions in which it would be legal, the game may also include wagering by the players according to specific payout rules.

9 Claims, 6 Drawing Sheets

FIG. 7
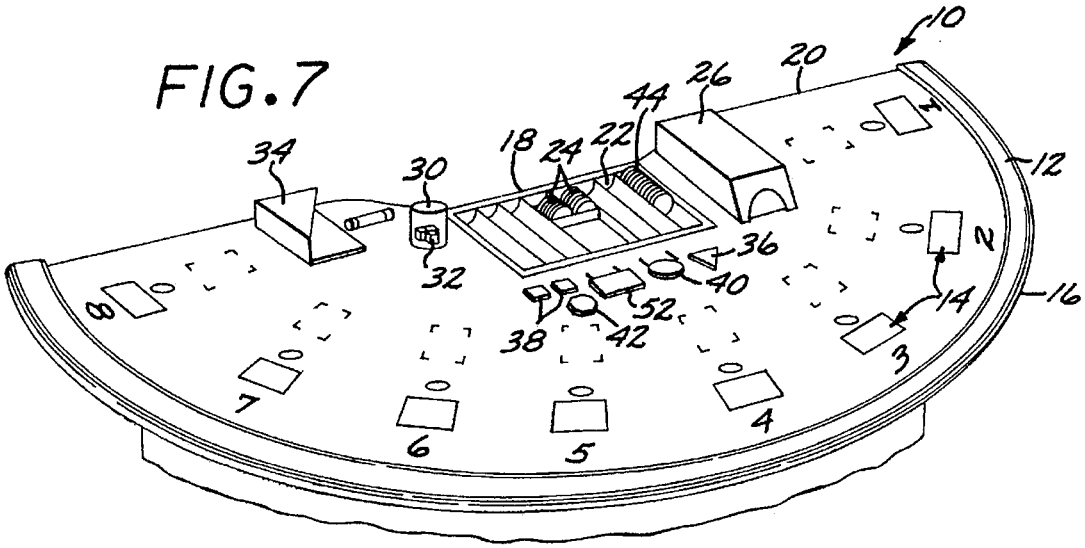
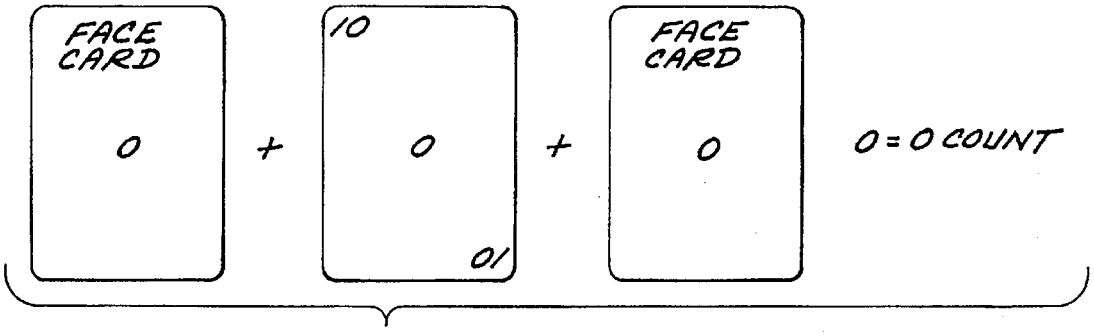
FIG. 5

CARD GAME METHOD OF PLAY AND WAGERING

BACKGROUND OF THE INVENTION

The present invention relates generally to the field of card games. More specifically, it relates to a method of playing cards using a standard 52 card deck of four suits (Clubs, Hearts, Diamonds and Spades), and thirteen ranks (Ace through 10, Jack, Queen and King), and to the apparatus employed for playing the game in a casino.

Card games of various types are very popular in casinos. Such games as "Blackjack" ("21") and "baccarat" are among the most popular because they have relatively simple rules, they can be played quickly, and they employ elements of both chance and skill. There is a constant demand for new games that meet these criteria.

An example of a known card game is disclosed in U.S. Pat. No. 5,275,415—Wisted, wherein the object of the game is to win a gambling pot by approaching or reaching a predetermined unique point total. Scores closest to the target point total and equally above or below that target total are co-winners, and each player plays for money or chips against all the others.

It is an object of the present invention to provide a card game that can be played with or without casino gambling, employs simple, easy to learn rules, and supplies entertaining action to its participants. It is another object to provide a card game that utilizes existing paraphernalia including a standard 52 card deck.

SUMMARY OF THE INVENTION

The present invention is a method of playing cards with one or more standard decks of 52 cards, each deck comprising four suits (Clubs, Diamonds, Hearts, and Spades) and thirteen ranks (Ace through 10, Jack, Queen and King) wherein each of several players is dealt three cards, and is given the opportunity either to "stand pat", or to discard and draw a card, with the object of achieving a winning score based on the high value of the cards in the hand, the lowest score being zero and the highest being 10.

More specifically, the cards are valued as follows: Ace is valued at one; two through nine are valued at the face value of the respective cards; and ten and "face" cards (Jack, Queen, and King) are valued at zero. Three cards in a hand totaling 10, 20 or 30 in value count as zero, excerpt that three face cards in a hand are given the highest score, viz., 10. Card totals from 11 to 19 are scored one to nine, respectively, as are totals of 21 to 29.

In play, each player, including a preselected reference player designated the "banker", is initially dealt three cards face down. The player may elect to play the cards as dealt, i.e., "stand pat", or to discard one of the three cards and draw a card from the previously undealt portion of the deck to replace it. After each non-"banker" player has played his or her hand in this way, the banker displays his or her hand, all the cards then held are turned up, and all players having a higher score than the banker declared winners. A score that ties that of the banker is declared a "push", status, as explained below.

In a casino, where gambling is legal, each player places a wager (antes up) before playing the hand. After the winner or winners are declared, money settlements begin with a preselected "action player"; the winners are paid clockwise in, turn only to the extent of the losing wagers on the table and the banker may lose only the amount of his or her wager.

If winners exceed losers, unpaid winners receive "courtesy time", i.e. may play the subsequent game without having to ante up. A tie with the banker is considered a "push", and does not entitle the tying player(s) to courtesy time.

The present invention also includes specific apparatus for playing the game in a casino (in those jurisdictions where such casinos are legal). Specifically, the apparatus comprises a table with a plurality of stations, each of which accommodates a player, one of whom is designated the banker for each hand. There is also a station for the dealer, who is not a player, except when called on by one of the non-banker players to perform "house-way" play, i.e., drawing or standing pat according to a set of criteria that is different from that of a regular player.

BRIEF DESCRIPTION OF THE DRAWINGS

FIGS. 1 through 5 are pictorial views illustrating representative hand scores according to the point scoring system of the present card game invention;

FIG. 7 is a perspective view of a gaming table suitable for use with the present card game and illustrating the positions of the players and a dealer;

DETAILED DESCRIPTION OF AN EXEMPLARY EMBODIMENT

The object of the present game is for a player to achieve the highest score possible with three cards in a hand by strategically standing pat or drawing one card to replace one of the three cards initially dealt to that player.

A. Scoring

One or more standard 52 card decks are used, with each rank symbol being counted according to the following easy-to-grasp scheme of point valuation: Ace is assigned the numerical value of one; two through nine are assigned numerical values corresponding to the respective face value of the card; and ten and the face cards (Jack, Queen, and King) are valued at zero. The score of a three card hand is the sum of the numerical values of the three cards. Any combined three-card total above nine whose sum ends in a given units digit is simply scored at that units digit (e.g., a combined total of a King (zero) plus a six plus a seven, with an arithmetic sum of 13, has a score of 3).

Nine would be the highest score achievable by the pattern so far just described; however, an element of interest is added to establish a supreme hand as follows. Whereas generally any other combination of tens or face cards would be scored at zero, the special circumstance of three face cards in a hand is given a predetermined maximum value that beats all other scores. This predetermined maximum value may thus be defined as ten.

FIGS. 1 through 5 depict representative hands of three cards each to illustrate the foregoing scoring scheme. FIG.

Figure 1:
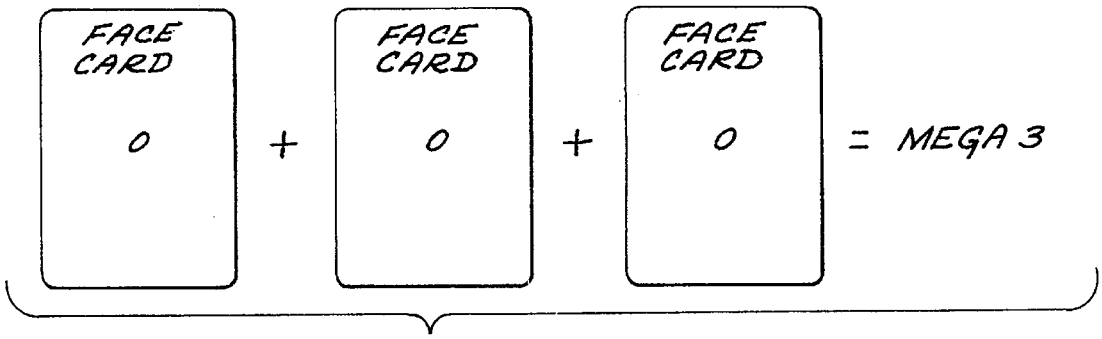
Figure 2:
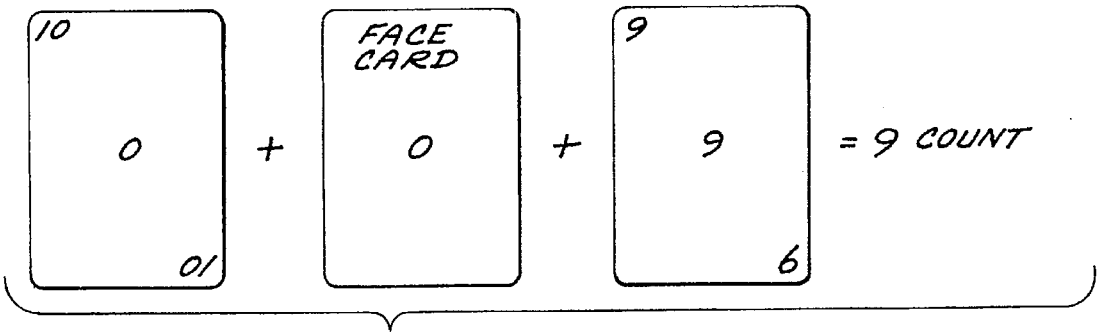
Figure 3:
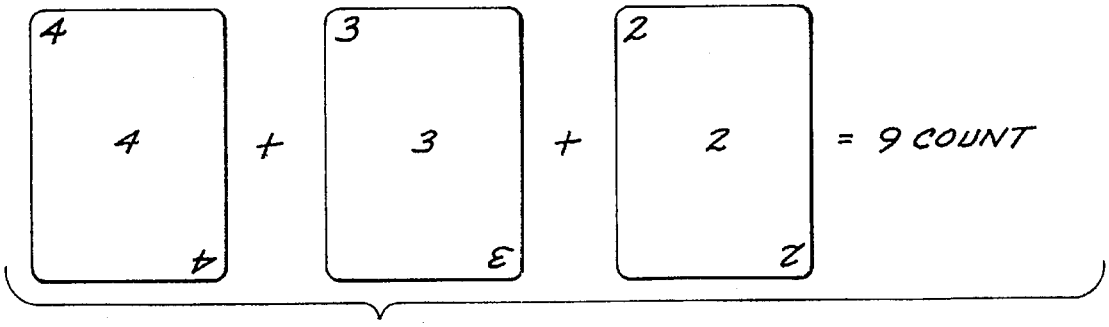
Figure 4:
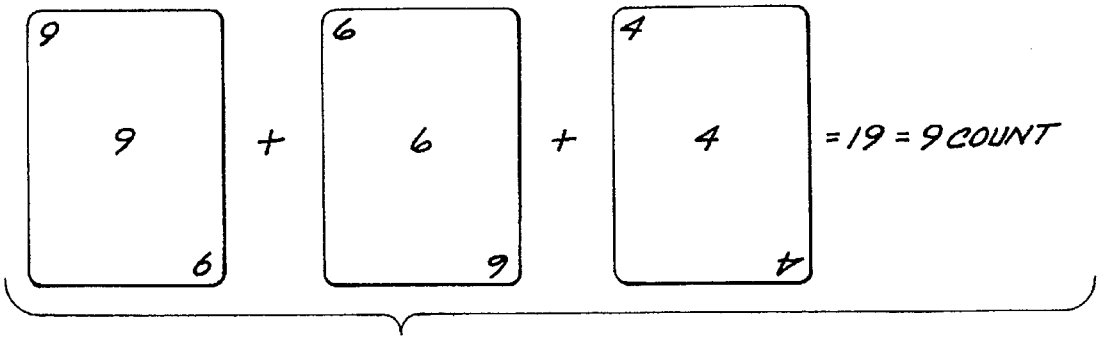

1 illustrates the hand valued at the highest score obtainable, which hand I have called "Mega 3", comprising three face cards and thus valued at "10". FIG. 2 shows a face card and a ten, both valued at zero, so that the total is merely the value of the remaining card, viz., "9". FIG. 3 illustrates the simple arithmetic sum of three numbered cards that total "9", whereas FIG. 4 shows how the sum of cards exceeding nine is scored by counting the units digit ("9") as the score. Finally, FIG. 5 reinforces the general rule that the score for any combination of cards with zero value is "0" except for the "Mega 3" combination of all face cards.

To begin play, one or more decks of 52 cards are shuffled and cut according to any customary procedure suitable to the players, and the game proceeds as illustrated in the flow diagram of FIG. 6, to be described below. The present game may be played with any of a variety of wagering schemes (where wagering is legal), or without wagering, if desired. The functional blocks of FIG. 6 distinguish between the regular play, designated by rectangular blocks, and casino play, designated by the blocks labeled "optional". For ease of reference to equipment, FIGS. 7 through 10 illustrating a casino table setup will be used to describe either method of play.

B. Basic Equipment

Turning to FIG. 7, a game apparatus 10 in an exemplary embodiment includes a generally semicircular or semi-elliptical table 12 having preferably eight player stations 14 arranged evenly around a curved portion 16 of the table 12, and a dealer station 18 centered in a straight portion 20 of the table 12. Components of the dealer's station 18 include a tray 22 holding chips 24; a shoe 26 from which playing cards 28 are dealt; a dice cup 30 and dice 32 (three dice 32 being used in the preferred embodiment); a discard rack 34; and various markers or "buttons", including an action button 36, two house-way buttons 38, a banker's hand button 40, a "no action" button 42 and ten courtesy time buttons 44. There may also advantageously be a banker's number button 52, having one side printed with the numeral "1", and the other side printed with the numeral "2". The functions of the various buttons will be described below.

Figure 8:
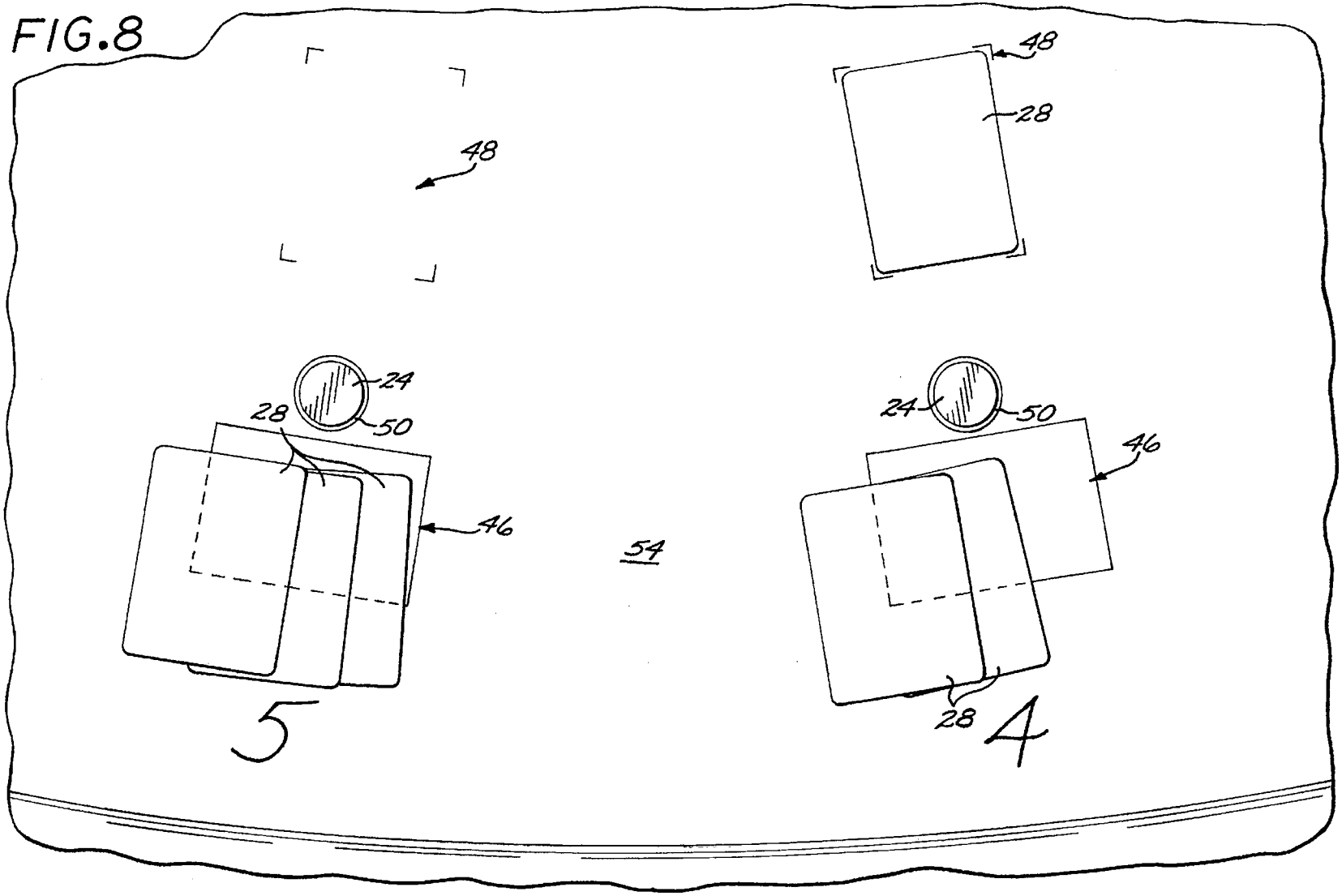
FIG. 8 is an enlarged-view of two typical player stations of the table of FIG. 7.
Figure 9:
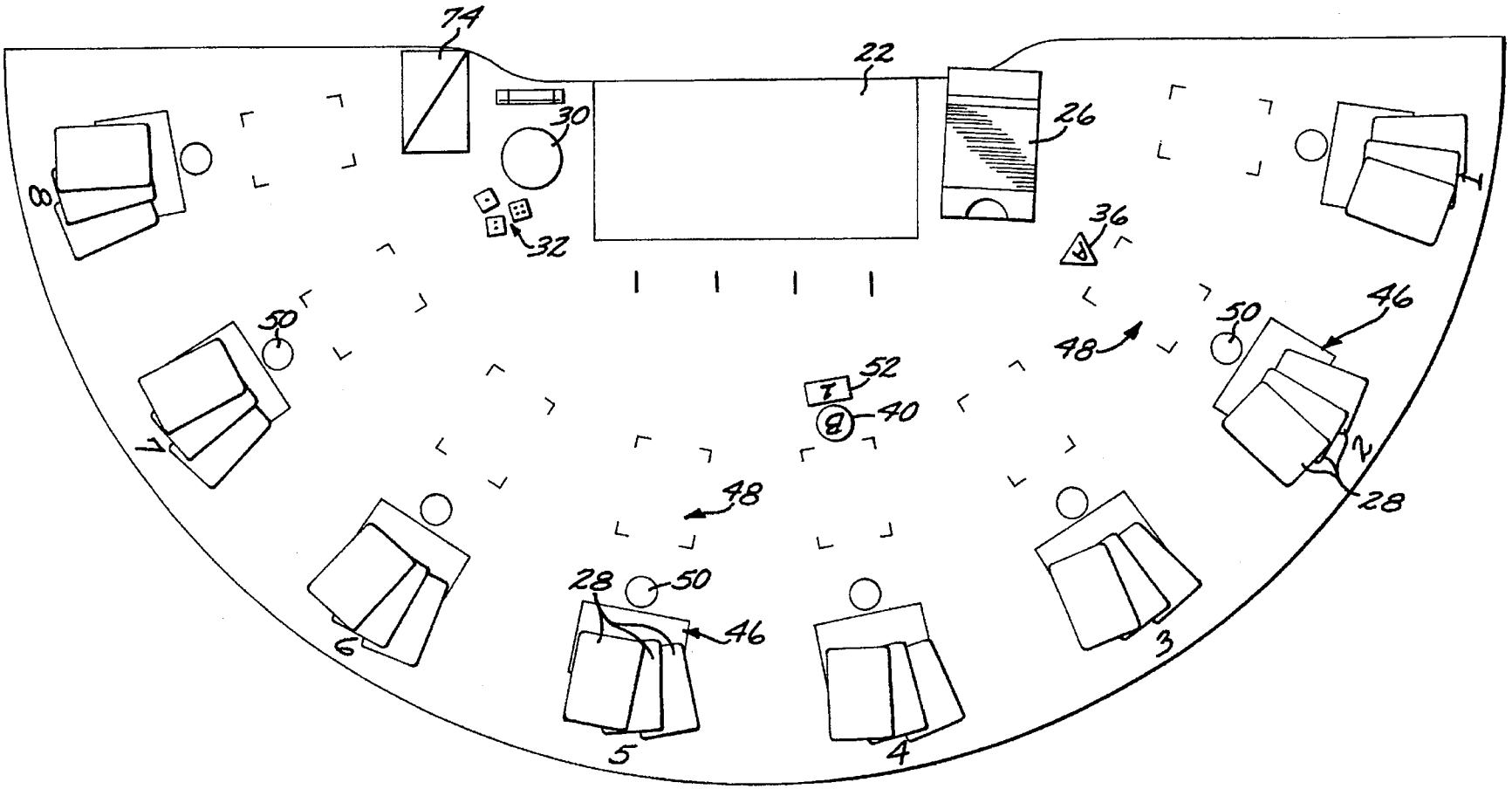
FIG. 9 is a plan view of the table of FIG. 7 illustrating the positions of cards and game equipment after a first round of dealing.

A closer view of typical player stations 14 is shown in FIG. 8, illustrating for example stations No. 4 and No. 5. Station No. 4 comprises a hold area 46 containing two of three cards 28 dealt to that station. The third card 28 is shown occupying a discard area 48 disposed between the hold area 46 and the dealer station 18. Interposed between the hold area 46 and the discard area 48 is a preferably circular area 50 for the placement of wagering chips 24 (used in the casino method of play) used in the wager for each hand dealt.

Each of the areas 46, 48, and 50 is preferably printed or otherwise marked on a playing surface 54, usually a green felt pad or similar material. At station No. 5, all three of the cards 28 are shown in the hold area 46, the player having chosen to stand pat at this phase of the game so that the discard area 48 is empty.

It will be understood that additional wagering areas and associated collection areas (not shown) may be included for making side bets without departing from the spirit or scope of the present invention.

C. Method of Play

Turning again to FIG. 6, a detailed explanation of each functional block will aid in the understanding of the present invention. Preliminarily, as suggested above, one or more standard decks of 52 cards are Shuffled and cut according to any customary practice suitable to the players. As many as eight decks of cards may be used and shuffled together when there are eight players at the table. Fewer decks may be used for a smaller number of players.

Figure 6:
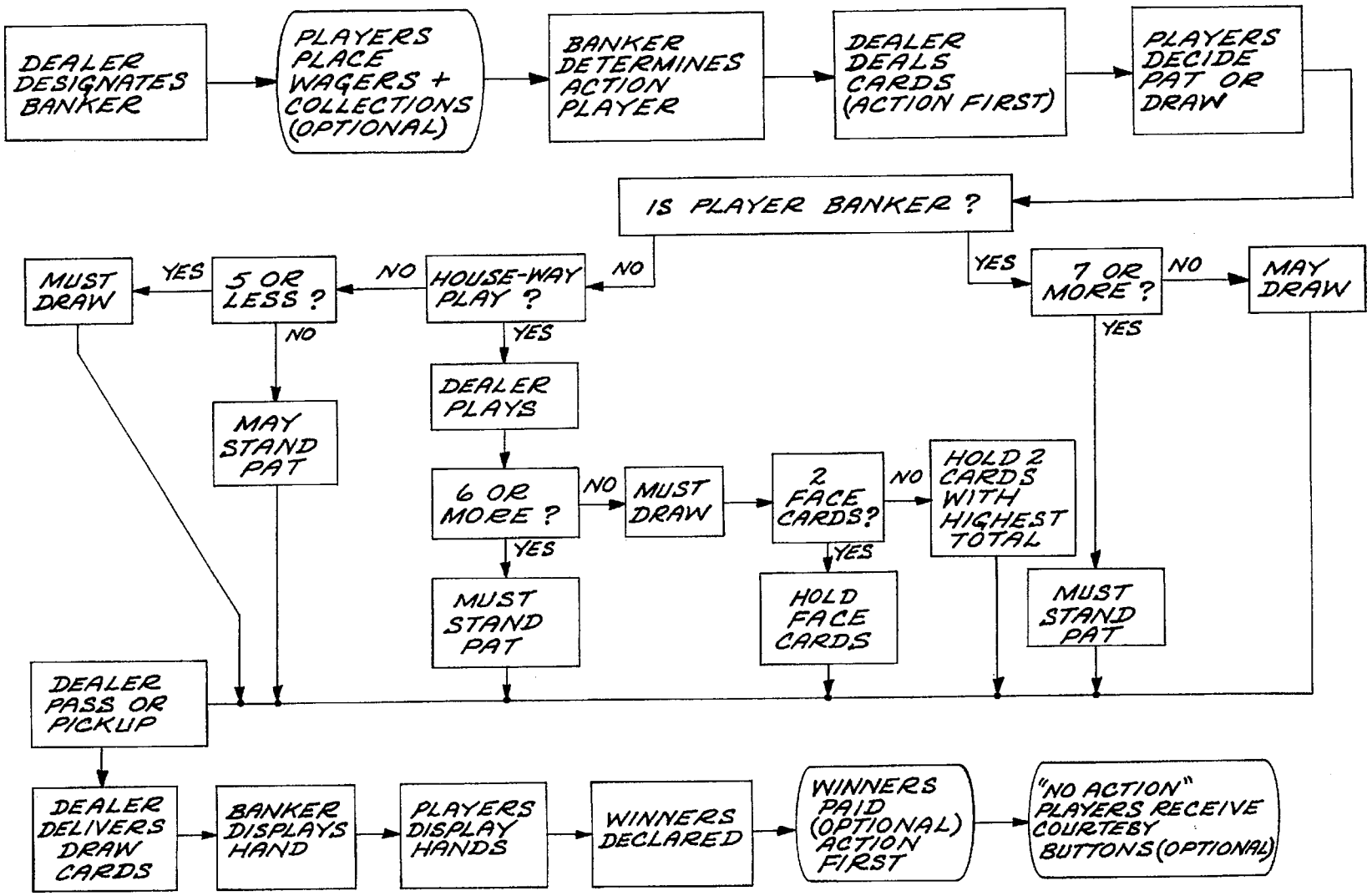
FIG. 6 is a functional block diagram illustrating the method of play utilizing the scoring system of FIGS. 1 through 5.

As the first block in FIG. 6 indicates, one of the players is chosen by a non-playing dealer to be a reference player (and called a "banker" in either casino or non-casino play). The mechanism of choosing the banker may be any acceptable to the dealer, including designating the first player to arrive at the table, rolling of the dice. 32, or a similar fair selection plan. The banker's hand button 40 and the action button 36 are then placed in front of the banker's station. The player selected a banker serves in that capacity for two successive hands before another player is designated. During the banker's first hand, the banker's number card 52 (if used) is placed in front of the banker with the numeral "1" facing up; on the banker's second hand the banker's number card 52 is flipped over to expose the numeral "2". Alternatively, the banker's hand button 40 may sere as a banker's number button, if it includes the appropriate numerical marking on each side.

The next block (labeled "optional", signifying casino play), represents the placing of the wager chips 24 by each player. Any player that did not receive a "courtesy time" button or marker 44 in the previous round of play is required to pay to the house a specified minimum number of chips 24 as an ante.

Next, the banker rolls the three dice 32 and counts clockwise from the banker's station the amount shown on the dice to determine an "action" player. For example, the banker's position for purposes of counting on the dice is 1 or 9 or 17 in an eight-player configuration, regardless of the banker's actual station number. This may be more readily grasped by referring to FIG. 9, wherein the banker's station is No. 4 and the dice count is 7. Counting 7 places clockwise starting from the banker's position (1), the action player is thereby the player at station No. 2. will be readily seen that the same player (No. 2) would be designated if the dice read 15. The action button 36 is then placed in front of the action player.

Next, the dealer dealt the cards 28 face down beginning with the action player until all players have three cards (the condition illustrated in FIG. 9), whereupon the dealer takes the banker's hand and places it face down in front of the tray 22 along with the banker's hand button 40.

Next, the players decide whether to stand pat or draw, with the banker being the last to play his or her hand. A player who is not the banker must first decide whether to request the dealer to play his or her (the player's) hand, an option known as "house-way". The following series of blocks up to but not including the "dealer pass or pickup" block constitute a decision tree of criteria for drawing or standing pat depending on one's status as player, banker or "house-way" dealer.

Figure 10:
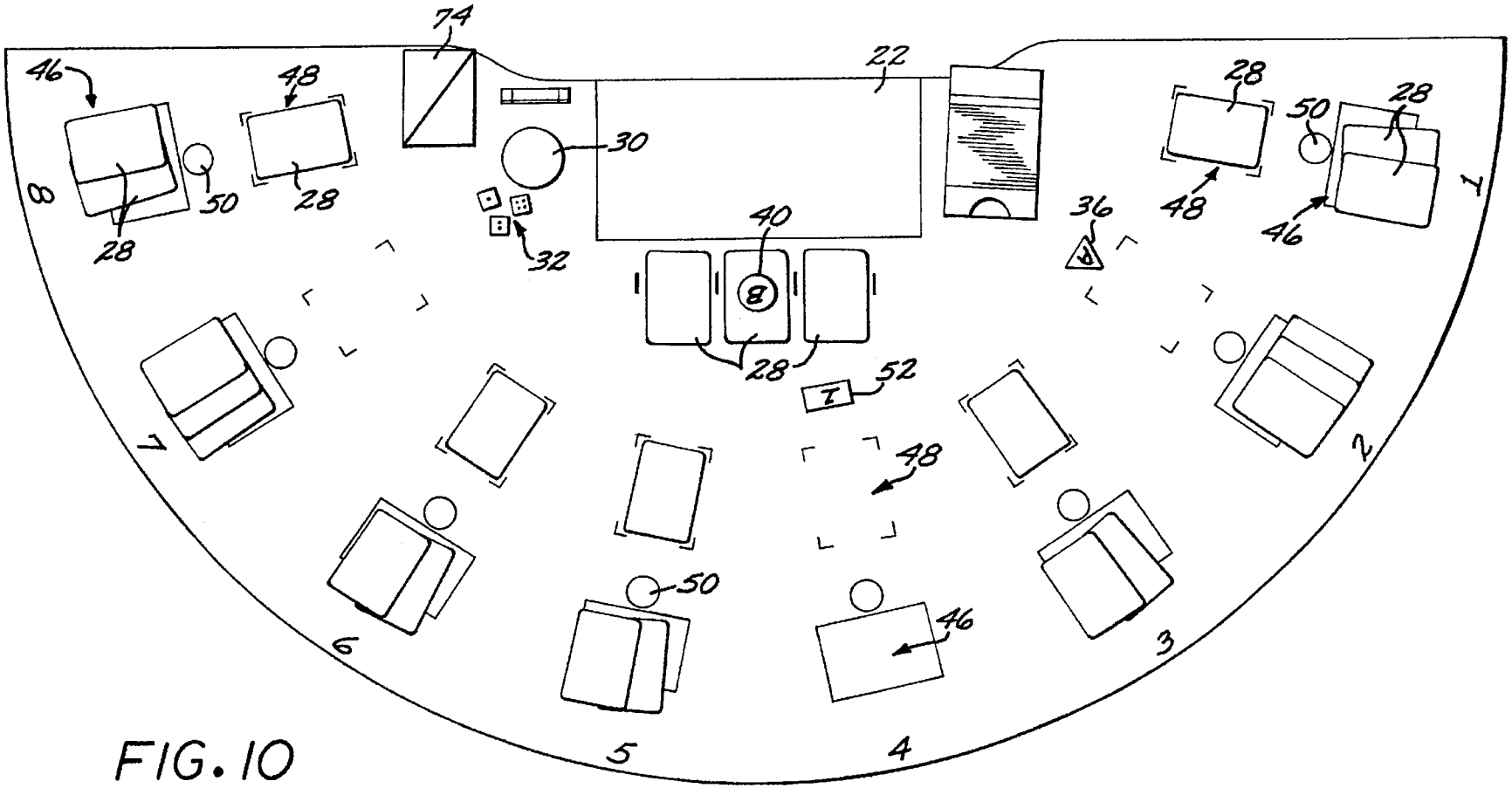
FIG. 10 is a plan view of the table of FIG. 9 illustrating an exemplary position of cards and game equipment after a second round of dealing.

A player designated as the banker must stand pat with a hand having a count of 7 or more. With a count of 6 or less, the banker may discard one card and draw to replace it. If any non-banker player decides to play "house-way", the dealer plays that player's hand, and must stand pat if the count is 6 or more, but also is required to draw if the count is 5 or less. If a draw is required, the two cards in the hand with the highest total must be kept, unless the hand includes two face cards, in which case the face cards must be kept. Finally, a player who does not request "house-way" play must draw with a score of 5 or less, and may draw if the count is 6 or more. The condition of the table configuration after all the non-banker players have made their plays is illustrated in FIG. 10.

Next, the dealer, starting at the station next clockwise to the banker, passes the pat hands and picks up the discarded cards 28 resting in the respective discard areas 48, placing the discards 28 in the discard rack 34. Referring again to FIG. 10, the players at stations numbered 1, 3, 5, 6 and 8 have chosen to draw, while those at stations 2 and 7 are standing pat. The banker's hand (station No. 4) has not yet been played.

Next, beginning again at station No. 5, the dealer delivers replacement cards 28 to the drawing players (stations 1,3,5,6 and 8, plus the banker if appropriate according to the rules of draw previously described).

Next, the banker's hand is displayed by turning the cards 28 face up. As each player in turn, beginning with the action player (here, at station 2) turns up his or her cards, those hands which score less than the banker's score are turned face down again. A player wins by having a score that is higher than that held by the banker.

In casino play, the next ("optional") block represents the money settlements beginning again with the action player (station No. 2).

If the action player's score is higher than the banker's score, the action player is paid the amount of his or her wager (up to the amount of the banker's wager), since the banker's wager is available to fund the payment. Similarly, any winning player in rotational turn will be paid the amount of his or her wager, as long as the banker's wager is sufficient to fund the payment.

Next, since the banker may lose only the amount of his or her wager, any winning player who is not paid ("no action") because of a deficiency in the payout amount is issued a courtesy time button or marker 44 entitling that unpaid winning player to play the subsequent game without having to ante up. Such a player who is tied with the banker, however, is not issued the courtesy time button 44.

The arrangements described above are for purposes of example only, and a number of variations and modifications may suggest themselves to those skilled in the pertinent arts. For example, although the card game described above does not require the use of "wild cards" or jokers in addition to the standard 52-card deck, the game can readily be adapted for play with one or more jokers. Such variations and modifications are considered to be within the spirit and scope of the present invention, as defined by the following claims.

I claim:

1. A method of playing a card game among a plurality of players wherein the objective is to hold a hand of cards with a total point count that is as close as possible to a predetermined maximum point count in accordance with a predetermined point scoring system, said method comprising the steps of:

providing a deck of at least 52 cards having a numerical value from zero to nine assigned to it;

designating one of the players as a banker;

providing a dealer to deal the cards to the players;

dealing by the dealer of an initial hand of three cards face down to each player in rotation and none to the dealer;

looking at their respective cards by each player and employing the point scoring system by adding the assigned numerical values of the cards in each hand to compare the point count of each hand to the predetermined maximum point count;

deciding by each player either to stand pat by keeping the three cards in the initial hand, or to discard one card of the initial hand and draw a card to replace it;

dealing by the dealer of a single card face down from the portion of the deck remaining undealt to each player signifying a decision to draw a card; and declaring as a winner any player having a hand of three cards with a total point count exceeding that of the banker.

2. The method of claim 1, wherein the deck includes four aces each having a numerical value of one, four cards assigned each of the numerical values of two through nine, and sixteen cards each assigned the numerical value of zero, of which twelve are face cards, and wherein the point scoring system scores a three card hand as the units digit of the sum of the numerical values of the cards in the hand, except that the sum of three face cards is defined as ten, which is the predetermined maximum point count.

3. The method of claim 2, wherein the banker is required to stand pat with a hand having a point count greater than or equal to seven.

4. The method of claim 2, further comprising, for each non-banker player, after the dealing step, the step of deciding whether to play "house way" with the dealer playing that player's hand, whereby the dealer is required to stand pat with a hand having a point count greater than or equal to six, and is required to discard and draw a card with a hand having a point count less than or equal to five.

5. The method of claim 2, wherein each non-banker player is required to discard and draw a card with a hand having a point count less than or equal to five.

6. A method of playing a card game among a plurality of players wherein the objective is to hold a hand of cards with a total point count that is as close as possible to a predetermined maximum point count in accordance with a predetermined point scoring system, said method comprising the steps of:

providing a deck of at least 52 cards, wherein the deck includes four aces each assigned a numerical value of one, four cards assigned each of the numerical values of two through nine, and sixteen cards each assigned the numerical value of zero, of which twelve are face cards;

providing a point scoring system that scores a three card hand as the units digit of the sum of the numerical values of the cards in the hand, except that the sum of three face cards is defined as ten, which is the predetermined maximum point count;

designating one of the players as a banker;

providing a dealer to deal the cards to the players;

dealing by the dealer of an initial hand of three cards face down to each player in rotation and none to the dealer;

looking at their respective cards by each player and employing the point scoring system by adding the assigned numerical values of the cards in each hand to compare the point count of each hand to the predetermined maximum point count;

deciding by each player either to stand pat by keeping the three cards in the initial hand, or to discard one card of the initial hand and draw a card to replace it;

dealing by the dealer of a single card face down from the portion of the deck remaining undealt to each player signifying a decision to draw a card; and declaring as a winner any player having a hand of three cards with a total point count exceeding that of the banker.

7. The method of claim 6, wherein the banker is required to stand pat with a hand having a point count greater than or equal to seven.

8. The method of claim 6, further comprising, for each non-banker player, after the dealing step, the step of deciding whether to play "house way" with the dealer playing that player's hand, whereby the dealer is required to stand pat with a hand having a point count greater than or equal to six, and is required to discard and draw a card with a hand having a point count less than or equal to five.

9. The method of claim 6, wherein each non-banker player is required to discard and draw a card with a hand having a point count less than or equal to five.

* * * * *